US006162133A

United States Patent [19]

Peterson

[11] Patent Number: 6,162,133

[45] **Date of Patent: *Dec. 19, 2000**

[54] GOLF CLUB HEAD

[76] Inventor: Lane Peterson, 810 Baker St., #111, Costa Mesa, Calif. 92626

[ * ] Notice: This patent issued on a continued prosecution application filed under 37 CFR 1.53(d), and is subject to the twenty year patent term provisions of 35 U.S.C. 154(a)(2).

[21] Appl. No.: 08/963,089

[22] Filed: Nov. 3, 1997

[51] Int. Cl.[7] ..... A63B 53/04

[52] U.S. Cl. ..... 473/345; 473/346; 473/350

[58] Field of Search ..... 473/345, 346, 473/347, 348, 349, 350, 324, 332

[56] References Cited

U.S. PATENT DOCUMENTS

| | | | |
|---|---|---|---|
| 1,568,888 | 1/1926 | Dunn | 473/334 |
| 4,021,047 | 5/1977 | Mader . | |
| 4,214,754 | 7/1980 | Zebelean | 473/350 |
| 4,429,879 | 2/1984 | Schmidt | 473/346 |
| 4,432,549 | 2/1984 | Zebelean . | |
| 4,523,759 | 6/1985 | Igarashi | 473/350 |
| 4,602,787 | 7/1986 | Sugioka et al. . | |
| 4,804,023 | 2/1989 | Enomoto et al. | 473/345 |
| 4,930,781 | 6/1990 | Allen | 473/346 |
| 5,292,129 | 3/1994 | Long et al. . | |
| 5,470,069 | 11/1995 | Schmidt et al. | 473/346 X |
| 5,603,666 | 2/1997 | Bowe | 473/307 |
| 5,624,331 | 4/1997 | Lo et al. . | |
| 5,632,693 | 5/1997 | Painter | 473/318 |
| 5,711,722 | 1/1998 | Miyajima et al. | 473/346 |
| 5,776,011 | 7/1998 | Su et al. | 473/345 |

*Primary Examiner*—Kien T. Nguyen
*Attorney, Agent, or Firm*—Workman, Nydegger & Seeley

[57] ABSTRACT

A golf club head is formed with a unitary, one-piece body including a top crown, sole plate, face plate and side skirt. The side skirt includes an opening, and a cap is configured to cover the opening. Preferably, the cap is connected to the side skirt by a snap fit or interference fit. The interior portion of the golf club head preferably includes a reinforcement structure which supports the face plate. Desirably, the reinforcement structure includes three vertical ribs which are connected to the top crown, face plate and sole plate to form part of the one-piece body.

48 Claims, 4 Drawing Sheets

GOLF CLUB HEAD

FIELD OF THE INVENTION

The present invention relates in general to golf clubs, and more particularly to a golf club head.

BACKGROUND

Golf clubs are typically divided into three main classes—the putters, irons and woods. The woods are generally used to hit the golf ball a long distance and the woods are traditionally constructed from wood, such as persimmon. Today, however, many woods are constructed from metal, which are generally referred to as metal woods. Metal woods allow the weight of the club head to be balanced and weight distributed around the periphery of the club head, which allows the location and size of the sweet spot of the club head to be adjusted.

A conventional metal wood is shown in U.S. Pat. No. 4,432,549 issued to Zebelean which discloses a metal driver that is cast in two parts. The first part or body includes a face plate, top crown, and sides which surround a large opening; and the second part includes a sole plate or bottom surface which is configured to fit into the large opening in the first part of the club head. After casting, the sole plate is welded to the body to form the golf club head of the metal driver. This golf club head, however, is unsatisfactory because it includes two components that must be welded together, which involves a significant amount of time and increases cost of the club head. Additionally, the lie, loft and face angle of the club head often undesirably changes because the independently formed components do not always mate in an identical manner, and the sole plate is not always welded to the body at the same angle. Thus, significant resources must be used to test and eliminate defects that occur because the sole plate and the body are not always joined at the same manner, which further increases the complexity of the manufacturing process.

Conventional metal woods which require welding the sole plate to the body are unsatisfactory because not all welds are identical. For example, differences in penetration and sealing of a weld affect the strength and structural integrity of the club head, which changes the characteristics of the club head. Welding also undesirably increases the weight and the thickness of the club head, and the differently sized welds cause an unequal weight distribution in a club head. This added weight is disadvantageous because a light-weight club head is important, and the weight is desirably positioned only in specific locations. Additionally, welding not only introduces variables during the manufacture of a single club head, it also causes variation between different club heads. Further, pieces of the weld inside the club head may break off during play. These pieces, which are located inside the sealed club head, rattle every time the club is used. The annoying rattle requires additional time, effort, money and materials to correct.

Conventional club heads are finished with a large degree of care to create the desired appearance and esthetics. For example, golf club heads are often subjected to the expensive and time consuming steps of grinding, sanding, sand blasting, polishing, tumbling and painting to finish the club head. Conventional club heads require that these steps be completed after the components are welded together because the high temperature welding will destroy or mar a finished club head. Disadvantageously, it is difficult to modify or customize the club head after it is welded together. For example, the Zebelean patent discloses filling the hollow club head with a hardening material, such as polyurethane. The Zebelean patent explains that, after the sole plate is welded to the body and the club head is finished, an opening is drilled through the center of the sole of the club head to insert the hardening material. Various types of plugging screws are used to close the opening. This golf club head is unsatisfactory because drilling the opening, filling the club head with the hardening material and sealing the opening often damages or mars the polished surface of the club head. Further, the plugging screw alters the weight and balance of the club head.

Another conventional golf club head is shown in U.S. Pat. No. 4,021,047 issued to Mader which discloses a two piece metal club head held together by mechanical fasteners. The Mader patent discloses a sole plate, face plate and hosel which are cast out of a unitary piece of metal. A wood or plastic cap fits along the top of the face plate and extends to the rear surface of the club head to form a crown and rear capping piece. The cap is attached by two screws which extend through the sole plate and hollow cavity of the club head. This golf club head, however, is unsatisfactory because the mechanical fasteners tended to loosen during play, add unnecessary weight to the club head and the weight is added to the club head in undesired locations.

Another conventional golf club head is shown in U.S. Pat. No. 5,292,129 issued to Long, et al. The Long patent discloses a metal golf club head which is reinforced by three ribs which extend between the internal surface of the striking face and the internal surface of the top side to reinforce both the striking face and the top side. This golf club head is unsatisfactory because the sole plate must be welded to the body of the golf club, and the reinforcement ribs are not interconnected to the sole plate. Disadvantageously, this allows sole plate to deform and buckle when striking a golf ball.

Therefore, there is a need for a golf club head without these significant disadvantages. In addition, there is a need for an improved golf club head which does not require welding or mechanical fasteners to attach the top crown or sole plate to the face plate.

SUMMARY OF THE INVENTION

One aspect of the invention is a golf club head with a unitary, one-piece body including a face plate, top crown and sole plate. Advantageously, the face plate, sole plate and top crown of the golf club are always correctly positioned in the desired configuration, and this eliminates variations in lie, loft and face angle. Significantly, the golf club head of the present invention does not require welding or other types of fasteners to attach the sole plate or top crown to the face plate. Because welding or mechanical fasteners are not required, the manufacturing process is simplified and more of the weight of the golf club can be distributed in the desired locations.

Another aspect is a golf club head with a reinforcement structure which strengthens the face plate of the golf club head. Preferably, the reinforcement structure includes one or more ribs which are integrally formed with the top crown, face plate and sole plate of the club head. Advantageously, the reinforcement structure strengthens the top crown, face plate and sole plate of the club head. Thus, the club head does not significantly deform when the face plate strikes the golf ball. In addition, the reinforced club head provides increased elasticity or rebound to the club face, which results in more energy transferred to the golf ball so that the ball can travel a greater distance.

In one embodiment of the invention, the golf club head includes a unitary, one-piece body having a top crown, a face plate, a sole plate and a side skirt. The side skirt includes an opening which provides access to an interior portion of said one-piece body, and a cap is configured to cover the opening in the side skirt.

In another embodiment of the invention, the golf club head includes a face plate and a sole plate which are integrally connected to form a single unit. The club head also includes a top crown connected to the face plate, and a side skirt is connected to the top crown, face plate and sole plate. The face plate, sole plate, top crown and side skirt form a generally hollow body.

In a further embodiment of the invention, a method of making a golf club head includes forming a unitary one-piece body including a face plate, a top crown, a sole plate, a side skirt, and an opening in said side skirt; forming a side skirt cap configured to cover the opening in the side skirt; and attaching the side skirt cap to the body. Preferably, the one-piece body further includes a reinforcement structure which reinforces the face plate.

BRIEF DESCRIPTION OF THE DRAWINGS

These and other features of the present invention will now be described with reference to the drawings of preferred embodiments, which are intended to illustrate and not to limit the invention, in which.

DETAILED DESCRIPTION OF PREFERRED EMBODIMENTS

Figure 1:
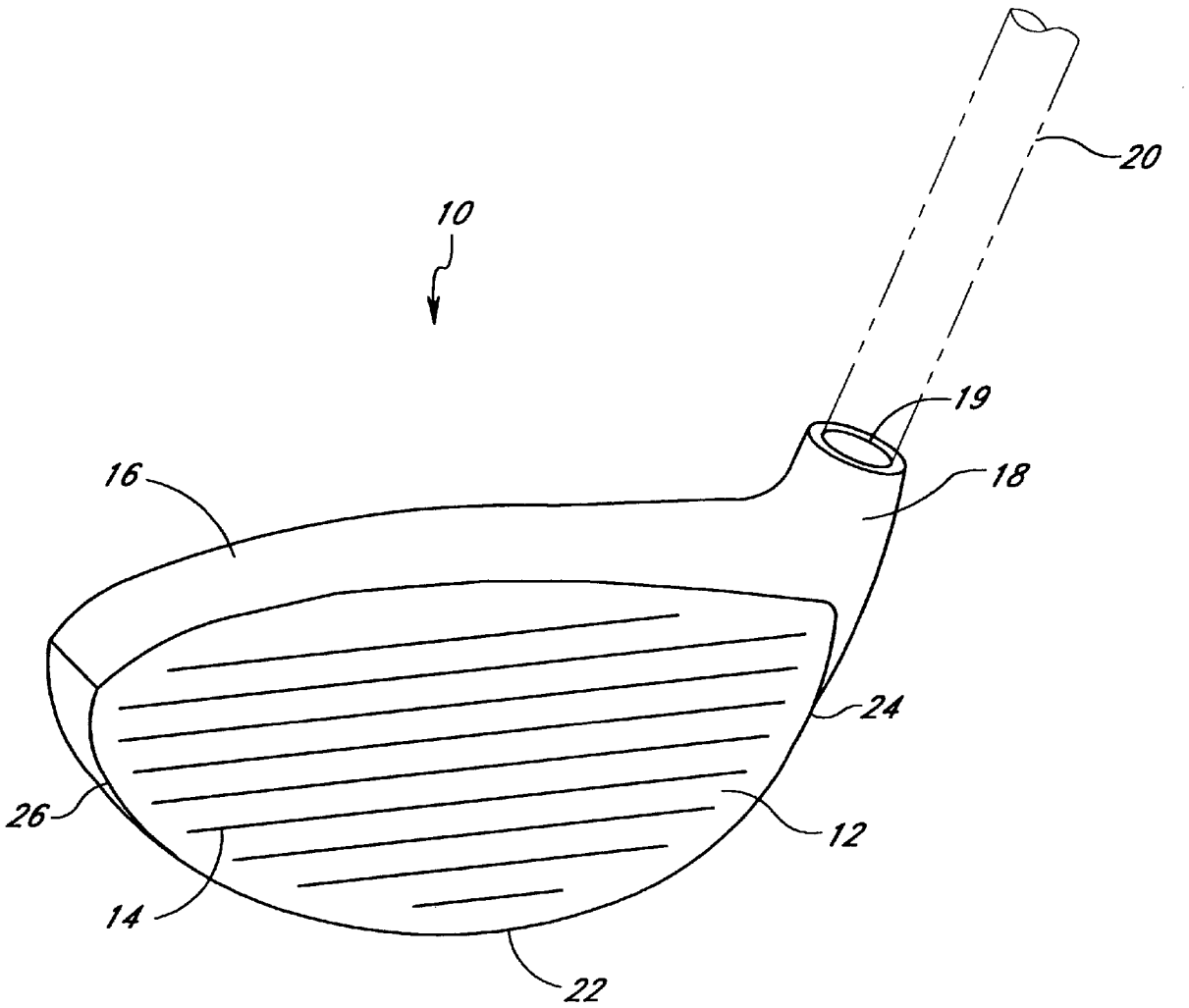
FIG. 1 is a perspective front view of a golf club head in accordance with an embodiment the present invention.

As shown in FIG. 1, the golf club head 10 includes a face plate 12 which is adapted to strike a golf ball. The face plate 12 includes a plurality of grooves 14 which preferably extend the majority of the length of the face plate, and the grooves 14 may be generally U-shaped or V-shaped in configuration. The grooves 14 preferably conform to the United States Golf Association ("USGA") rules, but any grooves or no grooves may also be used. The club head 10 also includes a top crown 16, a hosel or neck 18 which is configured to receive a shaft 20 (shown in phantom), and a sole plate 22. The hosel 18 includes an opening 19 and the upper portion of the hosel preferably extends between about ¼ inch (0.6 cm) and 1 inch (2.5 cm), and more preferably about ½ inch (1.2 cm), above the upper surface of the top crown 16. Alternatively, the club head 10 may include a longer or shorter hosel 18, or no hosel. Preferably, the opening 19 in the hosel 18 extends through the club head 10 and sole plate 22, and the shaft 20 is inserted through the opening and finished flush with the bottom surface of the sole plate 22. The hosel 18 may also be a blind hosel in which the opening 19 extends through only a portion of the club head 10 and not through the sole plate 22.

The golf club head 10 shown in the accompanying figures and described below is a driver or one wood, but the club head may also be any other type of wood. In addition, the golf club 10 shown in the accompanying figures and described below is an "over-sized" golf club which is larger in size than a traditional golf club, but the club head may also be, for example, a "mid-sized" or "regular-sized" club head. Further, the club head 10 may be connected to any type of desired shaft 20, such as steel, graphite, titanium, or composite materials, and the shaft may be any desired size and length.

Figure 2:
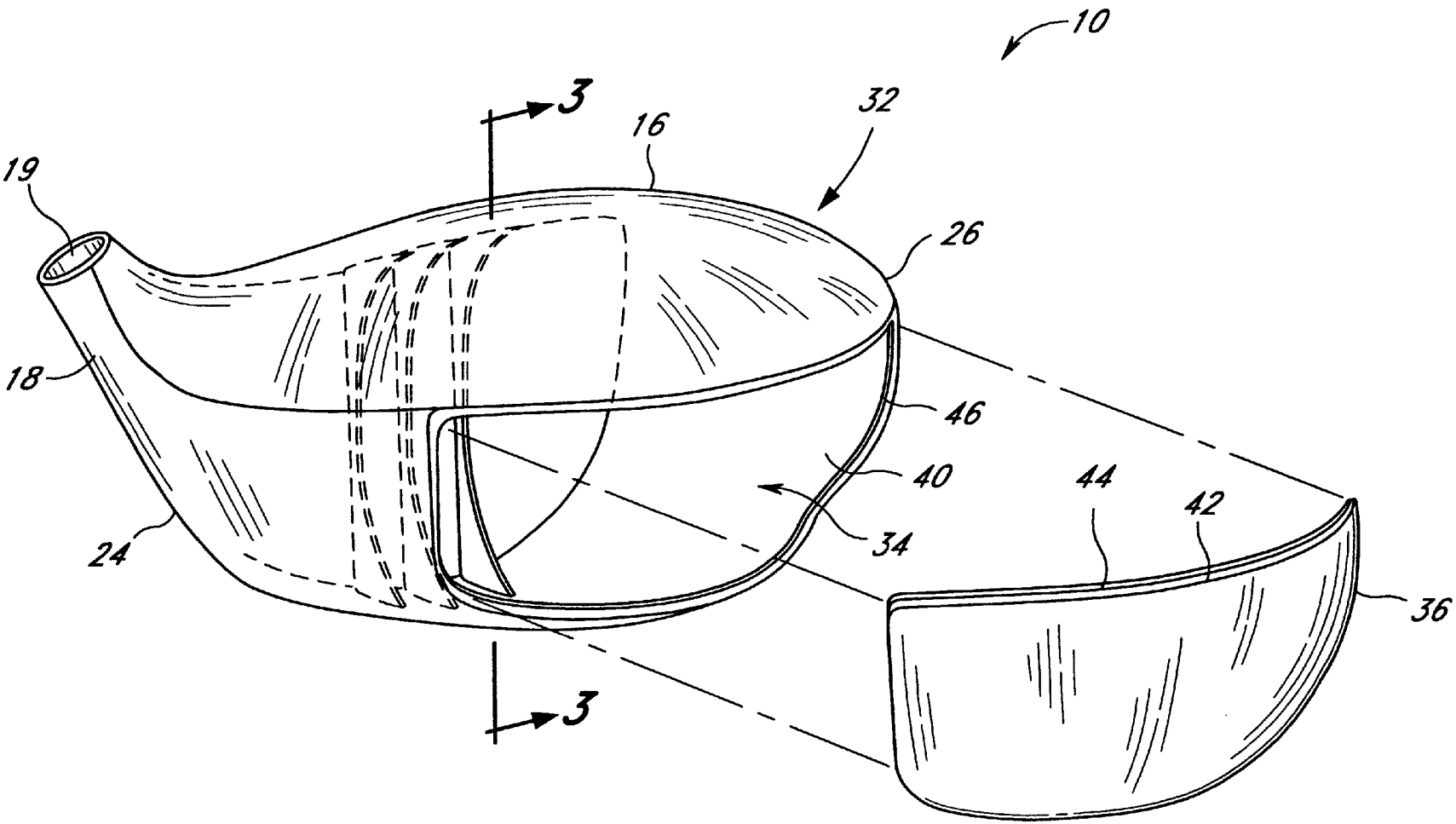
FIG. 2 is an exploded perspective back view of the golf club head shown in FIG. 1, illustrating the cap removed from the skirt.

As best seen in FIGS. 1 and 2, the golf club head 10 includes a heel 24 proximate the hosel 18 and a toe 26 distal the hosel 18, and side skirt 30 which extends around the golf club head 10. The skirt 30 is connected to the sole plate 22, top crown 16 and face plate 12 to form the body 32 of the club head 10. The side skirt 30 also includes an opening 34, and a cap 36 is configured to cover the opening 34. These different parts combine to form the exterior surfaces of the club head 10, and because the club head 10 is substantially hollow, each of these parts has a corresponding inner surface.

The face plate 12 and the top crown 16 or sole plate 22 are preferably formed as a unitary, one-piece component; and more preferably, the face plate 12, top crown 16 sole plate 22 and side skirt 30 are formed as a unitary, one-piece component. Because the face plate 12 and the sole plate 22 are formed as part of the one-piece body 32, the face plate and sole plate are always correctly positioned at the desired configuration and angle. Advantageously, because there is little or no variation between the angle of the face plate 12 and sole plate 22, each club head 10 will have essentially the same loft, lie and face angle.

Additionally, the one-piece body 32 greatly simplifies the manufacturing process because the sole plate 22 does not have to be welded to the face plate 12—this saves time and resources, and reduces the weight of the golf club. Reducing the weight of the club head 10 typically allows a higher club head speed, which results in more power and energy being transferred to the golf ball. Alternatively, instead of reducing the weight of the club head, the weight saved by the one-piece body can be used, for example, to make a larger sized club head and/or the weight can be redistributed within the club head. For example, the weight may be redistributed to change the center of gravity, additional weight may be positioned directly behind the club face, or additional weight may be distributed around the perimeter of the club head.

The club head 10 is preferably fabricated as a unitary, one-piece body 32 by casting, such as investment, die or lost wax casting; but the club head may also be forged, molded, pressed, or constructed by any other known means such as dynamic compaction or isostatic compaction. The one-piece body 32 is preferably constructed from a titanium alloy, such as titanium 6Al-4V, but any metal or metal alloy such as stainless steel or aluminum may also be used. Additionally, any composite or amorphous materials may be used to construct the body 32. Further, all or a portion of the body 32 may also be constructed from plastic or composite materials; and the face plate 12 may include an insert, such as graphite or other materials, on the front face designed to impact the golf ball.

The face plate 12 of the golf club head 10 preferably has a thickness in the range of about 0.06 inches (1.5 mm) to about 0.12 inches (3 mm), and more preferably about 0.08 inches (2 mm). The top crown 16 has a thickness of about 0.04 inches (1 mm), the sole plate 22 has a thickness of about 0.04 inches (1 mm), and the skirt 30 has a thickness of about 0.04 inches (1 mm). Of course, the thickness of either or all of these surfaces may also be larger or smaller depending, for example, upon the desired strength and configuration of the club head 10, or the materials used to construct the club head. The thickness may also be nonuniform and the thickness may vary to distribute the weight in the desired locations of the club head.

The face plate 12 desirably has a width of about 3.5 inches (88 mm) and a height of about 2.4 inches (60 mm), and the sole plate 22 desirably has a length of about 3.6 inches (91 cm). The overall volume of the club head 10 is preferably between about 15 cubic inches (250 cc) and about 18 cubic inches (300 cc). It will be understood the dimensions of the club head 10 may vary, for example, according to the type of club head and whether the club head is over-sized, mid-sized or regular-sized. The face plate 12 and the sole plate 22 are preferably constructed with a lie between about 55° and about 59°, and more preferably about 58°; and the soled or rest loft of the golf club is preferably between about 5° and about 13°. The face angle of the club head is preferably between about −1° and about +3°, wherein the minus sign indicates the "open" position and the plus sign indicates the "closed" position. Of course, these measurements may vary, for example, according to the type of club head and the preferences of the user. As discussed above, because the face plate 12 and sole plate 22 are desirably constructed as part of a one-piece body 32, these components are always correctly positioned at the desired configuration and angle such that there is little or no variation between club heads. Advantageously, this ensures each club head has the desired shape and characteristics.

Figure 3:
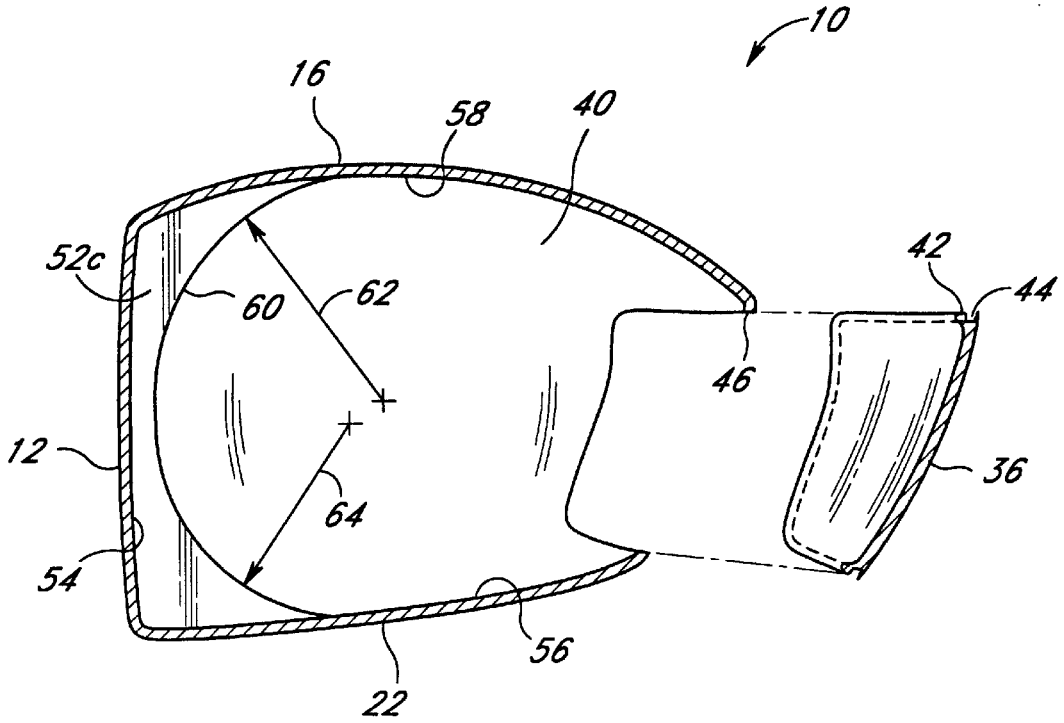
FIG. 3 is a cross-sectional side view along lines 3—3 of the golf club head shown in FIG. 2.
Figure 4:
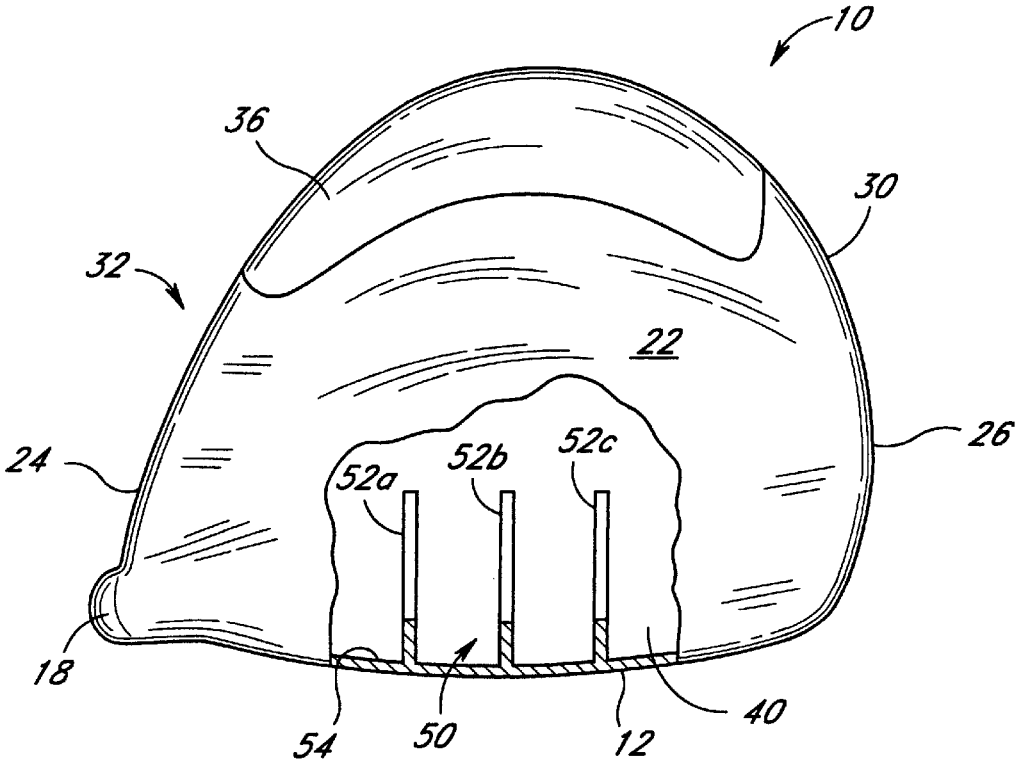
FIG. 4 is a bottom plan view of the golf club head shown in FIG. 1 with a portion of the top crown cut away, illustrating the reinforcement structure.

The body 32 of the club head 10 defines a substantially hollow interior portion 40. As shown in FIGS. 2–4, the opening 34 in the side skirt 30 provides access to the interior portion 40. The opening 34 is preferably located substantially opposite the face plate 12, but the opening may be located anywhere in the skirt 30. In addition, the opening 34 may include a portion of the top crown 16 or sole plate 22, or the opening may be entirely located in the sole plate or top crown. The opening 34 is preferably generally rectangular in configuration with a height of about 1 inch (2.5 cm) and a length of about 2 inches (5 cm), but the opening may also have other configurations such as circular or square, or be larger or smaller depending upon the desired size and configuration of the golf club 10.

The cap 36 is preferably configured and sized to cover the opening 34 in the skirt 30. As best seen in FIGS. 2 and 3, the cap 36 has an outer edge 42 with a groove 44 which extends around the outer perimeter of the cap, and the opening 34 in the skirt 30 has an inner edge 46. The groove 44 in the outer edge 42 of the cap 36 is configured to engage the inner edge 46 of the opening 34, such that the inner edge 46 fits securely within the groove 44. Desirably, this creates a "snap" fit between the cap 36 and the opening 34, which releasably secures the cap 36 to the body 32. Additionally, the cap 36 is preferably configured to cover the opening 34 in a manner which creates a generally smooth exterior surface of the skirt 30.

The cap 36 is attached to the opening 34 in the skirt 30 to enclose the substantially hollow internal portion 40. As discussed above, the cap 36 is preferably releasably connected to the skirt 30 by a snap fit; but a press fit, interference fit or fasteners such as bolts, screws and glue may also be used. Desirably, the removable cap 36 provides access to the interior portion 40, even after the club head is finished. Advantageously, because the cap 36 is not welded to the skirt 30, the club head can be finished in any desired manner and then the cap 36 closes the interior portion 40 without damaging or marring the finished surface.

The removable cap 36 advantageously allows materials and/or components to be simply and easily inserted or removed from the finished club head. For example, weight can be added to the heel 24 or toe 26 of the club head 10 to adjust the torque of the golf club head, or weight can be added to lower the center of gravity of the club head. Additionally, weight can be added or removed to balance the club head 10, or to adjust the club head to suit a golfer's particular style or preference. The cap 36 allows additional reinforcement material be added to the club head 10, or removed; and the cap 36 allows materials such as foam or polyurethane to be inserted into the club head 10 before, during or after the manufacturing process. Thus, the removable cap 36 allows the manufacturer, user or others to simply and easily modify and/or repair the club head 10, but the cap 36 may also be permanently connected to the skirt 30 by welding, fusing and the like. Desirably, the cap 36 is constructed in accordance with the rules of the USGA such that the club head can be used in competition.

The cap 36 may be constructed from the same material as the one-piece body 32 and the cap may be cast at the same time the one-piece body. For example, the cap 36 may be produced as part of the body 32, and then the cap may be cut out of the body such that the cap 36 and the opening 34 have precisely the same size and configuration, but the cap can also be constructed separately from the body 32. While the cap 36 may be constructed from the same titanium alloy as the body 32, the cap is preferably constructed from a plastic material, but a wide variety of materials including any of a number of metals, polymers, composites or amorphous materials may be used to construct the cap 36. Further, the cap 36 preferably has a thickness of about 0.04 inches (1 mm), but the thickness may also be larger or smaller depending, for example, upon the desired strength and configuration of the cap 36.

A reinforcement structure 50 is located within the interior portion 40 of the club head 10. The reinforcement structure 50 is desirably positioned behind the face plate 12 and, more desirably, integrally connected to the face plate to form a single unit. The reinforcement structure 50 strengthens the face plate 12 and increases the structural rigidity of the club head 10, which allows the club head to withstand repeated impacts with a golf ball. The structure 50 also helps prevent the energy of the club head from being absorbed (and therefore lost) by deformation of the face plate 12 when the club head 10 strikes the golf ball. The result of such deformation is a loss of energy transfer from the club head 10 to the golf ball, and thus a loss of initial ball velocity which undesirably results in less distance traveled by the golf ball. It will be understood that the club head 10 does not require the use of the reinforcement structure 50.

As best seen in FIGS. 2 and 3, the reinforcement structure 50 is integrally connected to the face plate 12, top crown 16 and sole plate 22 of the club head 10 as part of the one-piece body 32. Thus, the reinforcement structure 50 advantageously strengthens not only the face plate 12, but also the top crown 16 and sole plate 22. The reinforcement structure 50 allows a thinner face plate 12, top crown 16 and/or sole plate 22 to be used, while retaining the structural integrity of the club head 10. As seen in FIGS. 2–4, the reinforcement structure 50 includes three reinforcing ribs 52A, 52B and 52C which extend vertically along the interior surface 54 of the face plate 12, with one end attached to the inner surface 56 of the sole plate 22 and the other end attached to the inner surface 58 of the top crown 16. The center rib 52B is preferably located proximate the center of the face plate 12 and the other ribs 52A and 52C are spaced about ½ inch (1.2 cm) apart. Of course, additional or fewer ribs 52 may be utilized, the ribs may be spaced closer or further apart, and the ribs 52 could be at an angle and even horizontal relative to the face plate 12.

As best seen in FIG. 4, the ribs 52A–C each have a thickness of about 0.04 inches (1 mm) and a generally rectangular cross-section, but the thickness and configuration of the ribs may vary depending, for example, upon the desired strength of the ribs. The individual ribs may also have different shapes and characteristics. As seen in FIG. 2, the inner portion 60 of the ribs 52 is curved with a first, upper radius of curvature 62 and a second, lower radius of curvature 64. The upper radius of curvature 62 is preferably between about 2 inches (5 cm) and about 4 inches (10 cm); and the lower radius of curvature 62 is preferably between about 2 inches (5 cm) and about 4 inches (10 cm); but the radius of curvature may be larger or smaller. Desirably, the length of the rib from the inner surface 54 of the face plate to the inner section 60 of the rib 52 is between about ¼ inch (0.6 cm) and about ½ inch (1.2 cm) proximate the center of the rib; while the length of the rib proximate top crown 16 is between about ½ inch (1.2 cm) and about 1 inch (2.54 cm); the length of the rib proximate the sole plate 22 is between about ½ inch (1.2 cm) and about 1 inch (2.54 cm). Desirably, the curved inner section 60 of the rib 52 decreases the weight of the club head 10, but the ribs may also be straight or have another configuration.

Figure 5:
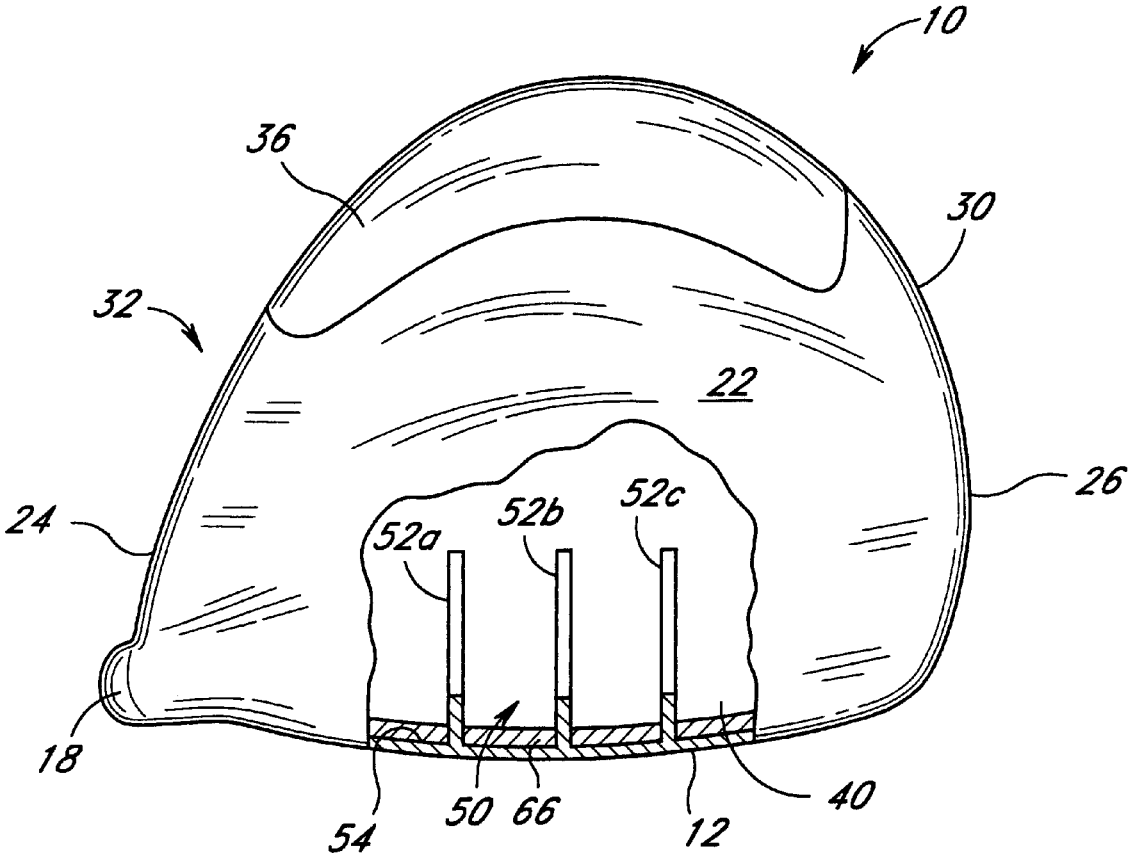
FIG. 5 is the bottom plan view of the golf club shown in FIG. 4, illustrating reinforcing material on the inner surface of the face plate.

As shown in FIG. 5, the club head 10 may also include reinforcing material 66 which is installed in the inner portion 40 of the club head, preferably behind the face plate 12. The reinforcing material 66 further increases the rigidity of the face plate 12, and may be used with or without the ribs 52. The reinforcing material 66 is preferably constructed from a carbon material, such as graphite, but any material which increases the rigidity of the face plate may be utilized. Advantageously, the reinforcing material 66 can be added after the club head 10 is constructed and finished, without damaging the finished surfaces, because the reinforcing material may be inserted through the opening 34 in the one-piece body 32 of the club head 10.

The present invention also includes a method of making substantially identically-shaped golf club heads 10. The method includes forming the face plate 12, top crown 16, sole plate 22 and skirt 30 as a unitary, one-piece body 32. The onepiece body is desirably formed by investment lost was casting, but the body may also be formed by die casting, injection molding, dynamic compaction, isostatic compaction, forging, lamination and the like. Desirably, the reinforcing ribs 52 are constructed as part of the unitary one-piece body 32. The cap 36 covers the opening 34 in the body 32 to seal the inner portion 40 of the club head. Advantageously, the cap 36 provides access to the inner portion 40 of the club head 10, for example, to change the weight of the club head or increase the strength of the club head.

Although this invention has been described in terms of certain preferred embodiments, other embodiments apparent to those of ordinary skill in the art are also within the scope of this invention. Accordingly, the scope of the invention is intended to be defined only by the claims which follow.

What is claimed is:

1. A wood-type golf club head, comprising:

a unitary, one-piece body including a top crown, a face plate and a sole plate, the one-piece body having a generally hollow interior portion, the top crown, face plate and sole plate of the one-piece body being generally thin-walled;

a side skirt attached to the one-piece body; and an opening substantially disposed in the side skirt to provide access to the interior portion of the one-piece body, the opening including a height extending between a lower edge located proximate the sole plate and an upper edge located proximate the top crown, the opening including a width extending between a first side edge and a second side edge, the width of the opening being greater than or generally equal to the height of the opening;

wherein the opening is sized and configured to allow a core to be removed from the interior portion of the one-piece body.

2. The golf club head of claim 1, wherein the first side edge is located proximate a toe of the golf club head and the second side edge is located proximate a heel of the golf club head.

3. The golf club head of claim 1, further comprising a cap attached to the side skirt to cover the opening in the side skirt.

4. The golf club head of claim 3, wherein the opening in the side skirt has an inner edge and the cap has an outer edge, and wherein the outer edge of the cap engages the inner edge of the side skirt when the cap is attached to the side skirt.

5. The golf club head of claim 1, wherein the side skirt is integrally formed as part of the one-piece body.

6. The golfclub head of claim 5, wherein the integrally formed, one-piece body including the top crown, the face plate, the sole plate and the side skirt are formed as part of a continuous structure to support the face plate without requiring any welding about the perimeter of the face plate.

7. The golf club head of claim 1, further comprising a reinforcement structure that reinforces the face plate of the one-piece body, the reinforcement structure forming a unitary part of the one-piece body.

8. The golf club head of claim 7, further comprising a reinforcement structure that is integrally attached to the face plate and the top crown to strengthen the intersection of the face plate and the top crown.

9. The golf club head of claim 7, further comprising a reinforcement structure that is integrally attached to the face plate and the sole plate to strengthen the intersection of the face plate and the sole plate.

10. The golf club head of claim 7, wherein the reinforcement structure is integrally attached to the top crown, the face plate and the sole plate.

11. The golf club head of claim 7, wherein the one-piece body and the reinforcement structure are constructed as a single unit by investment lost wax casting.

12. The golf club head of claim 7, wherein the reinforcement structure includes one or more ribs.

13. The golf club head of claim 12, wherein the ribs have a generally curved inner surface.

14. The golf club of claim 12, wherein the ribs are a unitary part of the one-piece body, and the ribs are integrally attached to the face plate, the top crown and the sole plate.

15. The golf club head of claim 7, further comprising a reinforcement structure that is integrally attached to the face plate and the top crown to strengthen the intersection of the face plate and the top crown, and integrally attached to the face plate and the sole plate to strengthen the intersection of the face plate and the sole plate.

16. The golf club head of claim 7, further comprising a reinforcement structure that is integrally attached to the face plate and the top crown to strengthen the intersection of the face plate and the top crown, and is integrally attached to the face plate and the sole plate to strengthen the intersection of the face plate and the sole plate.

17. The golf club head of claim 1, further comprising a reinforcement structure helps prevent damage to the face plate, top crown and sole plate.

18. The golf club head of claim 1, wherein the opening in the side skirt is generally opposite the face plate.

19. A wood-type golf club head, comprising:

a unitary, one-piece body including a top crown, a face plate, a sole plate and a side skirt, the one-piece body having a generally hollow interior portion, the top crown, face plate, sole plate and side skirt of the one-piece body being generally thin-walled;

an opening substantially disposed in the side skirt to provide access to the interior portion of the one-piece body, the opening including a first edge located proximate the sole plate, a second edge located proximate the top crown, a first side edge located proximate a toe of the golf club head and a second side edge located proximate a heel of the golf club head; and a cap attached to the opening in the side skirt;

wherein the opening is sized and configured to allow a core to be removed from the interior portion of the one-piece body.

20. The golf club head of claim 19, further comprising a height of the opening measured from the first edge to the second edge, and a width ofthe opening measured from the first side edge to the second side edge, the width of the opening being generally equal to or greater than the height of the opening.

21. The golf club head of claim 19, wherein the opening has a generally rectangular configuration.

22. The golf club head of claim 19, further comprising a width of the opening measured from the first side edge to the second side edge of the club head, further comprising a first distance measured from the intersection of the face plate and the side skirt proximate the toe of the club head to the first side edge of the opening, and further comprising a second distance measured from the intersection of the face plate and the side skirt proximate the heel of the golf club to the second edge of the opening, the width of the opening being generally equal to or greater than the first distance.

23. The golf club head of claim 19, further comprising a width of the opening measured from the first side edge to the second side edge ofthe club head, further comprising a first distance measured from the intersection of the face plate and the side skirt proximate the toe of the golf club to the first side edge of the opening, and further comprising a second distance measured from the intersection of the face plate and the side skirt proximate the heel of the golf club to the second edge of the opening, the width of the opening being generally equal to or greater than the second distance.

24. The golf club head of claim 19, further comprising a height of the opening measured from the first edge located proximate the sole plate to the second edge located proximate the top crown, wherein a maximum height of the face plate is generally greater than or equal to the maximum height of the opening.

25. The golf club head of claim 19, further comprising a height of the opening measured from the first edge located proximate the sole plate to the second edge located proximate the top crown, and further comprising a height of the club head measured from the sole plate to the top crown, the height of the club head being greater than or generally equal to the height of the opening.

26. The golf club head of claim 19, further comprising an aperture in the top crown that is sized and configured to receive a golf club shaft, the aperture having an inside diameter, and further comprising a height of the opening measured from the first edge located proximate the sole plate to the second edge located proximate the top crown, the height of the opening being equal to or generally greater than the inside diameter of the aperture.

27. The golf club head of claim 19, further comprising a height of the opening measured from the first edge located proximate the sole plate to the second edge located proximate the top crown, the maximum height of the opening being greater than or generally equal to a minimum height of the side skirt.

28. The golf club head of claim 19, further comprising a height of the opening measured from the first edge located proximate the sole plate to the second edge located proximate the top crown, and further comprising a width measured from the first side edge to the second side edge, wherein the height and the width of the opening is greater than or generally equal to a wall thickness of the top crown, the face plate, the sole plate or the side skirt of the one-piece body.

29. A wood-type golf club head, comprising:

a one-piece body including a generally hollow interior portion, the one-piece body comprising:

a top crown having a wall thickness;

a face plate integrally connected to the top crown, the face plate having a wall thickness;

a sole plate integrally connected to the face plate, the sole plate having a wall thickness; and a side skirt integrally connected to the top crown and the sole plate, the side skirt having a wall thickness; and an opening substantially disposed in the side skirt, the opening providing access to the internal portion of the hollow body, the opening having a height and a width that are generally larger than the wall thickness of the top crown, the face plate, the sole plate or the side skirt.

30. The golf club head of claim 29, further comprising an integral reinforcement structure that reinforces the face plate of the one-piece body.

31. The golf club head of claim 30, wherein the reinforcement structure is attached to the face plate, the top crown and the sole plate.

32. A wood-type golf club head, comprising:

a unitary, one-piece body including a top crown, a face plate and a sole plate, the one-piece body being generally hollow;

a side skirt attached to the one-piece body;

an opening in the side skirt providing access to an interior portion of the one-piece body, the opening being sized and configured to allow a core to be removed through the side skirt; and one or more strengthening members integrally connected to the top crown, the face plate and the sole plate;

wherein the one or more strengthening members form part of the unitary, one-piece body.

33. The wood-type golf club head of claim 32, further comprising a cap sized and configured to cover the opening in the side skirt, wherein the opening in the side skirt has an inner edge and the cap has an outer edge; and wherein the outer edge of the cap engages the inner edge of the side skirt when the cap is attached to the side skirt.

34. The wood-type golf club head of claim 32, wherein the unitary, one-piece body including the top crown, the face plate and the sole plate are formed as part of a continuous structure to support the face plate without requiring any welding about the perimeter of the face plate.

35. The wood-type golf club head of claim 32, wherein a portion of the one or more strengthening members are continuous.

36. A golf club head comprising:

a generally hollow, unitary, one-piece body including a face plate, a sole plate and a top crown;

a side skirt attached to the one-piece body; and an opening in the side skirt that provides access to an interior portion of the one-piece body, the opening having a first edge located proximate the top crown and the opening having a second edge located proximate the sole plate.

37. The golf club head as in claim 36, wherein the opening is sized and configured to allow a core to be removed from an interior portion of the one-piece body.

38. A golf club head comprising:

a one-piece body including a generally hollow interior portion, the one-piece body comprising:

a top crown;

a face plate integrally connected to the top crown;

a sole plate integrally connected to the face plate; and a side skirt integrally connected to the top crown and the sole plate;

an opening in the side skirt that provides access to an interior portion of the one-piece body, the opening having a width measured from a first side edge located proximate a toe of the club head and a second side edge located proximate a heel of the club head;

a first distance measured from the intersection of the face plate and the side skirt proximate the toe of the golf club head to the first side edge of the opening; and a second distance measured from the intersection of the face plate and the side skirt proximate the heel of the golf club head to the second edge of the opening, the width of the opening being generally equal to or greater than the first distance or the second distance.

39. The golf club head of claim 38, further comprising a reinforcement structure that reinforces the face plate of the one-piece body, the reinforcement structure forming a unitary part of the one-piece body.

40. The golf club head of claim 38, further comprising a reinforcement structure helps prevent damage to the face plate, top crown and sole plate.

41. A golf club head comprising:

a one-piece body including a generally hollow interior portion, the one-piece body comprising:

a top crown;

a face plate integrally connected to the top crown;

a sole plate integrally connected to the face plate; and a side skirt integrally connected to the top crown and the sole plate;

an opening in the side skirt that provides access to an interior portion of the one-piece body, the opening having a height measured from a first edge located proximate the sole plate to a second edge located proximate the top crown, the opening having a width measured from a first side edge located proximate a toe of the club head and a second side edge located proximate a heel of the club head; and an aperture located in the top crown and being sized and configured to receive a golf club shaft, the aperture having an inside diameter generally equal to or smaller than the height or the width of the opening in the side skirt.

42. A golf club head comprising:

a one-piece body including a generally hollow interior portion, the one-piece body comprising:

a top crown;

a face plate integrally connected to the top crown; and a sole plate integrally connected to the face plate;

a side skirt attached to the one-piece body, the side skirt including a minimum height and a maximum height; and an opening in the side skirt that provides access to an interior portion ofthe one-piece body, the opening having a maximum height and a minimum height, the maximum height of the opening being generally equal to or greater than the minimum height of the side skirt.

43. The golf club head of claim 42, further comprising a reinforcement structure that reinforces the face plate of the one-piece body, the reinforcement structure forming a unitary part of the one-piece body.

44. The golf club head of claim 42, further comprising a reinforcement structure helps prevent damage to the face plate, top crown and sole plate.

45. A golf club head comprising:

a one-piece body including a generally hollow interior portion, the one-piece body comprising:

a top crown having a wall thickness;

a face plate integrally connected to the top crown, the face plate having a wall thickness; and a sole plate integrally connected to the face plate, the sole plate having a wall thickness;

a side skirt attached to the one-piece body, the side skirt having an outer wall thickness; and an opening in the side skirt that provides access to an interior portion ofthe one-piece body, the opening having a maximum size and a minimum size, wherein the minimum size of the opening is generally equal to or greater than the outer wall thickness of the face plate, the sole plate, the top crown or the side skirt.

46. The golfclub head of claim 3, wherein the integrally formed, one-piece body including the top crown, the face plate and the sole plate are formed as part of a continuous structure to support the face plate without requiring any welding about the perimeter of the face plate.

47. The golf club head of claim 45, further comprising a support structure that is integrally formed with the face plate and the top crown.

48. The golf club head of claim 45, further comprising a support structure that is integrally formed with the face plate and the sole plate.

* * * * *